US005482595A

United States Patent [19]

Harrington, IV et al.

[11] Patent Number: 5,482,595

[45] Date of Patent: Jan. 9, 1996

[54] METHOD FOR IMPROVING RETENTION AND DRAINAGE CHARACTERISTICS IN ALKALINE PAPERMAKING

[75] Inventors: John C. Harrington, IV; Michael A. Schuster, both of Jacksonville, Fla.

[73] Assignee: Betz PaperChem, Inc., Jacksonville, Fla.

[21] Appl. No.: 215,983

[22] Filed: Mar. 22, 1994

[51] Int. Cl.[6] ..... D21H 21/10

[52] U.S. Cl. ..... 162/168.3; 162/175; 162/181.3; 162/183

[58] Field of Search ..... 162/168.3, 168.2, 162/175, 181.3, 183

[56] References Cited

U.S. PATENT DOCUMENTS

| | | | |
|---|---|---|---|
| 4,066,495 | 1/1978 | Voight et al. | 162/168 NA |
| 4,470,877 | 9/1984 | Johnstone et al. | 162/124 |
| 4,548,676 | 10/1985 | Johnstone et al. | 162/135 |
| 4,798,653 | 1/1989 | Rushmere | 162/168.3 |
| 4,824,523 | 4/1989 | Wagberg et al. | 162/164.1 |
| 4,925,530 | 5/1990 | Sinclair et al. | 162/164.1 |
| 4,927,498 | 5/1990 | Rushmere | 162/168.3 |
| 5,127,994 | 7/1992 | Johansson | 162/168.3 |
| 5,167,766 | 12/1992 | Honig et al. | 162/168.3 |

*Primary Examiner*—Peter Chin

*Attorney, Agent, or Firm*—Alexander D. Ricci; Richard A. Paikoff; Gregory M. Hill

[57] ABSTRACT

A method of improving the drainage characteristics of a pulp slurry in a papermaking operation utilizing the sequential steps of adding alum, ionic polyacrylamide and cationic starch. The cationic starch can be added to the slurry prior to or after the primary screen.

14 Claims, 4 Drawing Sheets

WEST COAST MILL
DRAINAGE EVALUATION

ALUM + 3 LB/TON ANIONIC PAM
ALUM + 5 LB/TON CATIONIC STARCH + 3 LB/TON ANIONIC PAM
ALUM + 3 LB/TON ANIONIC PAM + 5 LB/TON CATIONIC STARCH

SHEAR RATE - 1000 RPM

ANIONIC PAM #1
CATIONIC STARCH #1

WEST COAST MILL
DRAINAGE EVALUATION OF CATIONIC STARCHES

SHEAR RATE - 1000 RPM

ANIONIC PAM #2

EAST COAST MILL
DRAINAGE EVALUATION

—o— ALUM + 1 LB/TON ANIONIC PAM
═◊═ ALUM + 1 LB/TON ANIONIC PAM + 5 LB/TON CATIONIC STARCH

SHEAR RATE - 1000 RPM

ANIONIC PAM # 3
CATIONIC STARCH # 1

NORTHEAST MILL
CSF DRAINAGE EVALUATION

—O— 5 LB/TON ALUM + ANIONIC PAM
—◇— 5 LB/TON ALUM + ANIONIC PAM + 5 LB/TON CATIONIC STARCH

SHEAR RATE - 1500 RPM

ANIONIC PAM # 3
CATIONIC STARCH # 1

METHOD FOR IMPROVING RETENTION AND DRAINAGE CHARACTERISTICS IN ALKALINE PAPERMAKING

FIELD OF THE INVENTION

The present invention relates to the process of making paper. Specifically disclosed is a method for improving the retention and drainage properties of the aqueous pulp slurry during the production of paper.

BACKGROUND OF THE INVENTION

Paper or paperboard is made by producing an aqueous slurry of cellulosic wood fiber, which may also contain inorganic mineral extenders or pigments, depositing this slurry on a moving papermaking wire or fabric, and forming a sheet from the solid components by draining the water. This process is followed by pressing and drying sections. Organic and inorganic chemicals are often added to the slurry before the sheet forming process to make the papermaking process less costly or more rapid, or to attain specific properties in the final paper product.

The paper industry continuously strives to improve paper quality, increase process speeds, and reduce manufacturing costs. The dewatering, or drainage, of the fibrous slurry on the papermaking wire is often the limiting step in achieving faster process speed. This is also the stage in the paper papermaking process which determines many paper sheet final properties.

Typically, a fibrous slurry is deposited on the papermaking wire from the headbox at a consistency (fiber and filler solids content) of 0.5 to 1.5%; the resultant fibrous mat that is removed from the wire at the couch roll and transferred to the pressing section is approximately 20% consistency. Depending upon the machine size and speed, large volumes of water are removed in a short period of time, typically 1 to 3 seconds. The efficient removal of this water is critical in maintaining process speeds.

Chemicals are often added to the fibrous slurry before the papermaking wire to improve the drainage performance on the machine wire. These chemicals and chemical programs are called drainage aids. Additional benefits, such as fines retention, are also obtained.

Papermaking retention aids are used to increase the retention of fine furnish solids in the web during the turbulent process of draining and forming the paper web. Without adequate retention of the fine solids, they are either lost to the process effluent or accumulate to excessively high concentrations in the recirculating white water loop and cause production difficulties including deposit buildup and impaired paper machine drainage. Additionally, insufficient retention of the fine solids and the disproportionate quantity of chemical additives which are adsorbed on their surfaces reduces the papermaker's ability to achieve necessary paper quality specifications such as opacity, strength, and sizing.

GENERAL DESCRIPTION OF THE INVENTION

This invention describes a method for draining water from the pulp slurry in order to facilitate paper formation by the addition of a cationic starch after the alum and polyacrylamide are added to the slurry. The addition order of the cationic starch is critical in the application of this invention; its addition at other feed points or in a different sequential order does not provide the significant improvements in drainage.

Cationic starch is commonly used in the papermaking process to increase interfiber bonding and to obtain paper strength properties or is used to emulsify synthetic internal sizing agents, such as alkenyl succinic anhydride (ASA). Starch is added to the thick stock, in the machine chest or stuff box, before the addition of wet-end process chemicals such as drainage aids. Alum and ionic polyacrylamide (PAM), typically anionic polyacrylamide, are also commonly used in alkaline papermaking to achieve improvements in drainage and fines retention. These are usually added near the fan pump or headbox, before the pulp slurry is deposited on the papermaking wire.

Alum and ionic PAM are understood to operate by a "patch model mechanism", as reviewed in PULP AND PAPER—CHEMISTRY AND CHEMICAL TECHNOLOGY, Chapter 17, "Retention Chemistry", James P. Casey, Third Edition, Volume III. As discussed in this chapter, alum operates as the low molecular weight cationic material or coagulant, and ionic PAM acts as the flocculant.

The coagulant must be added before the flocculant for effective drainage/retention performance. Laboratory evaluations of this system consisted of the addition of alum, followed by the addition of the ionic PAM, followed last by the cationic starch. A mill feed system comprises the alum being added at the fan pump, ionic PAM added after the fan pump or before the screen, and cationic starch added before or after the primary screen.

The starch added after the alum and PAM is independent of any starch previously added to the thick stock. The amount of starch added is in addition to the starch added to provide strength or emulsify internal size.

RELEVANT ART

U.S. Pat. No. 4,066,495 covers the use of a cationic starch followed by the addition of an anionic PAM for improved retention. Starch is generally added before the polymers.

U.S. Pat. Nos. 4,470877 and 4,548,676 (a continuation of the former) discuss the manufacture of gypsum board. Alum is used in acid conditions to buffer pH, and is used in alkaline conditions to acidify silicone surfactants. Cationic starch is used to emulsify internal size, and is added before the anionic PAM. The anionic PAM provides retention and drainage benefits. A synthetic cationic flocculant is also added before the anionic PAM to provide retention benefits. The cationic starch is added before the PAM and is used to emulsify internal size.

U.S. Pat. No. 4,798,653 covers the use of a cationic colloidal silica sol and an anionic PAM for retention and drainage.

U.S. Pat. No. 4,824,523 relates to the method of producing paper by the addition of a retention-dry strength system. This system consists of (I) a cationic starch; (II) an anionic PAM polymer; and (III) a non-starch cationic synthetic polymer. Cationic starch is not sufficiently charged to provide charge neutralization capabilities similar to alum, and thus an alum/PAM system is much more effective than a cationic starch/PAM system for drainage/retention. The cationic starch is providing dry strength in this system, with minimal effect on charge neutralization. The alum in this invention is to neutralize charge only, and provides no strength properties. Cationic starch can be utilized in this invention as the initial additive as discussed, with no effect on drainage. A cationic polymer is added last, and is specified to be non-starch.

U.S. Pat. No. 4,925,530 describes the separation of fiber and filler and treating them separately for increased strength. The fiber is treated with an ionic coagulant or flocculant; the filler is then treated with a starch of opposite charge. The treated fiber and fillers are then mixed to produce a sheet of increased strength.

U.S. Pat. No. 4,927,498 covers the improved retention and drainage with the addition of an anionic polyaluminosilicate microgel followed by the addition of cationic PAM or starch.

U.S. Pat. No. 5,127,994 discloses improved retention and drainage with the addition of an aluminum compound, a cationic PAM, and polymeric silicic acid. This system utilizes a cationic PAM, followed last by an anionic component—the polysilicic acid.

DETAILED DESCRIPTION OF THE INVENTION

Figure 1:
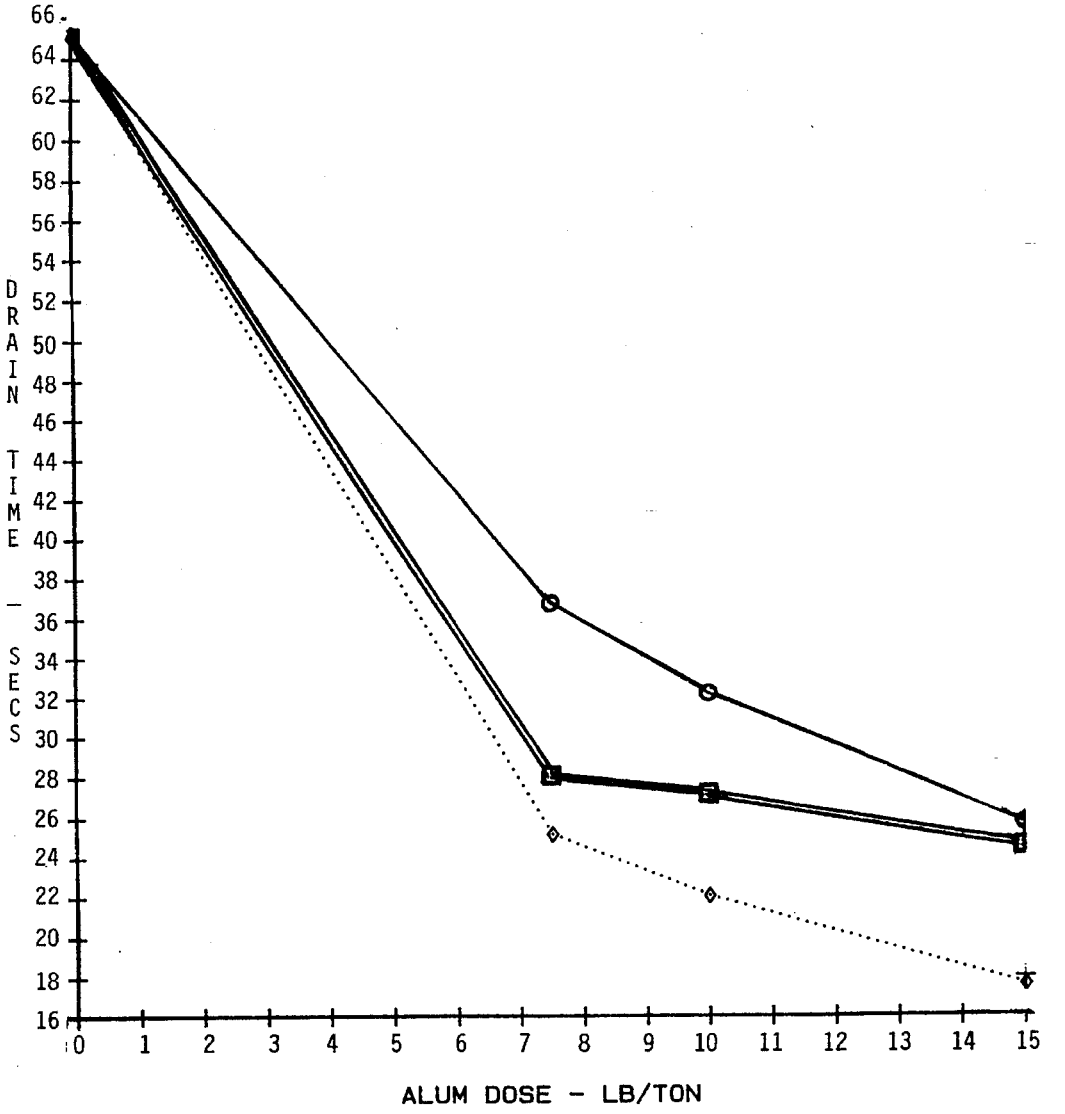
FIG. 1 shows the improvement in drainage using the addition of alum, anionic PAM and cationic starch

The cationic starch encompassed by the present invention can be derived from corn, potatoes, wheat, rice, or tapioca. Optimal results are obtained with an amylopectin based (branched structure) cationic starch derived from the listed sources, preferably a cationic waxy maize (amylopectin based corn starch ). Cationicity is imparted during manufacture by reaction of the starch with tertiary or quaternary amines. The total level of cationicity is defined by degree of substitution (DS) or average number of amine groups substituted for hydroxyl group per anhydroglucose unit of starch. The DS may range from 0.01 to 0.10; optimal results are obtained with a DS of 0.02 to 0.04. The cationic starch is first hydrated and dispersed in water before addition to the paper-making furnish. Either starches that require gelatinizing or "cooking" at the use location, or pre-gelatinized, cold-water dispersion starches can be used. Preferably the starch dispersion will contain about 0.1 to 10 weight % cationic starch. Typically, 10 to 30 pounds per ton active starch are added to the thick stock. As an additive for use with alum and PAM to improve drainage, levels range from 2.5 to 30 pounds per ton based on furnish consistency.

The alum utilized is technical grade aluminum sulfate, also known as papermakers alum. Other alum species, such as polyaluminum chloride (PAC), and the like may also be employed. Dosage levels utilized correlate with those used at actual mills, typically 5 to 15 lbs per ton based upon the pump slurry, or furnish, consistency.

The PAM utilized can be cationic or anionic, preferably anionic, with a mole % anionic monomer ranging from 1 to 60%, preferably 30 to 40%, and an intrinsic viscosity ranging from 5 to 30 dL/gram, preferably 15 to 25 dL/gram. The anionic monomer can be of those commonly used, and include but are not limited to acrylic acid or methacrylic acid. The anionic PAM can be either powder (100% active) or water-in-oil emulsion (30 to 40% active). Powder polymer levels range from 0.25 to 1.5 pounds per ton, with optimal results at 0.1 to 5.0 pounds per ton; emulsion levels range from 0.2 to 20 pounds per ton, with optimal results at 1.5 to 3 pounds per ton.

Visual observations during laboratory tests demonstrate floc formation of moderate size after the addition of the PAM; the further addition of cationic starch provides an even larger floc. This floc is then somewhat reduced in size by the additional mixing of the beaker agitator and sheet mold plunger. The resultant floc is still larger in size and more defined ("tighter") than a floc from an alum/PAM system. These visual observations would indicate the formation of a larger floc that is sheared into a "microfloc", producing channels or gaps in the fibrous mat during dewatering which provides a physical opening for the water to drain through, thus resulting in the documented faster draining times.

This invention exhibits the greatest utility in paper-making processes where heavier papers (>75 lbs/3300 $ft^2$) are being produced. This is because a thicker fibrous mat is used, which more significantly impedes water drainage.

EXAMPLES

Laboratory drainage evaluations were conducted on a British Standard Drainage device. (TAPPI test procedure number T-221 Om 88). Determinations are made initially with various volumes of pulp furnish to determine the appropriate volume of furnish which will produce a sheet of the desired basis weight. This volume is used in all testing, and is agitated in a separate container at a specific shear rpm consistent with the mill's processing conditions. The component test dosages are added and allowed to mix for 15 seconds each. This treated volume is then added immediately to the drainage device, where water is then added manually to the grooved line (approximately 6.9 liters total volume). This slurry is then mixed with the device plunger for 4 cycles. The draining lever is then depressed while simultaneously starting a timer capable of measuring to 0.1 seconds. The pulp slurry will then drain from the device, and is observed for fibrous mat formation on the device wire. The timer is stopped when all water has drained from the cylinder to the point where the fibrous mat formed has lost its gloss or sheen (simulating a dry line on a paper machine). The time of dewatering or drainage is noted for all component dosages. Drainage times were not converted to 60 gram/sq m OD (oven dried) per TAPPI T-221. The fibrous mat is removed for press and oven drying, and can then be utilized for additional paper property testing.

The following data will demonstrate the paper-making drainage efficacy of this invention.

Example 1

Bleached, kraft, softwood alkaline furnish from a west coast mill, refined to a 350 to 400 CSF (Canadian Standard Freeness), was evaluated for drainage improvements on the British Standard device at an equivalent 125 pound per 3300 square feet basis weight. The results are shown in Table I. The examples show the order of addition of the three components, as read from left to right.

TABLE I

| COMPONENT SYSTEM | COMPONENT DOSE, LB/TON | DRAIN TIME, SECONDS |
|---|---|---|
| BLANK | — | 65.0 |
| 1) ALUM/ANIONIC PAM #1 | 7.5/3.0 | 36.8 |

TABLE I-continued

| COMPONENT SYSTEM | COMPONENT DOSE, LB/TON | DRAIN TIME, SECONDS |
|---|---|---|
| (EMULSION) | 10/3.0 | 32.2 |
| | 15/3.0 | 25.7 |
| 2) ALUM/CATIONIC | 7.5/5.0/3.0 | 28.1 |
| STARCH #1/ | 10/5.0/3.0 | 27.2 |
| ANIONIC PAM #1 | 15/5.0/3.0 | 24.6 |
| 3) ALUM/ANIONIC PAM #1/ | 7.5/3.0/5.0 | 25.2 |
| CATIONIC STARCH #1 | 10/3.0/5.0 | 22.1 |
| | 15/3.0/5.0 | 17.6 |

Graphed data is illustrated in FIG. 1.

Treatment 3 demonstrates the drainage improvement of the invention.

Cationic starch #1 is a cationic amylopectin corn starch (waxy maize) with a % Nitrogen of 0.32%.

Anionic PAM is a 30% charge moiety with an intrinsic viscosity (IV) of 22 dl/gram.

Example 2

Pulp furnish from Example 1 was evaluated using various cationic starches. Results are shown in Table II.

TABLE II

| COMPONENT SYSTEM | COMPONENT DOSE, LB/TON | DRAIN TIME, SECONDS |
|---|---|---|
| 1) ALUM/ANIONIC PAM #2 | 5/1/5 | 24.7 |
| (POWDER)/ | 7.5/1/5 | 23.9 |
| CATIONIC STARCH #2 | 10/1/5 | 20.6 |
| 2) ALUM/ANIONIC PAM #2 | 5/1/5 | 32.0 |
| CATIONIC STARCH #3 | 7.5 /1/5 | 26.8 |
| | 10/1/5 | 21.9 |
| 3) ALUM/ANIONIC PAM #2/ | 5/1/5 | 36.4 |
| CATIONIC STARCH #4 | 7.5/1/5 | 31.7 |
| | 10/1/5 | 26.6 |
| 4) ALUM/ANIONIC PAM #2/ | 5/1/5 | 34.1 |
| CATIONIC START #5 | 7.5/1/5 | 27.7 |
| | 10/1/5 | 24.2 |
| 5) ALUM/ANIONIC PAM #2/ | 5/1/5 | 36.1 |
| CATIONIC STARCH #2 | 7.5/1/5 | 29.8 |

Figure 2:
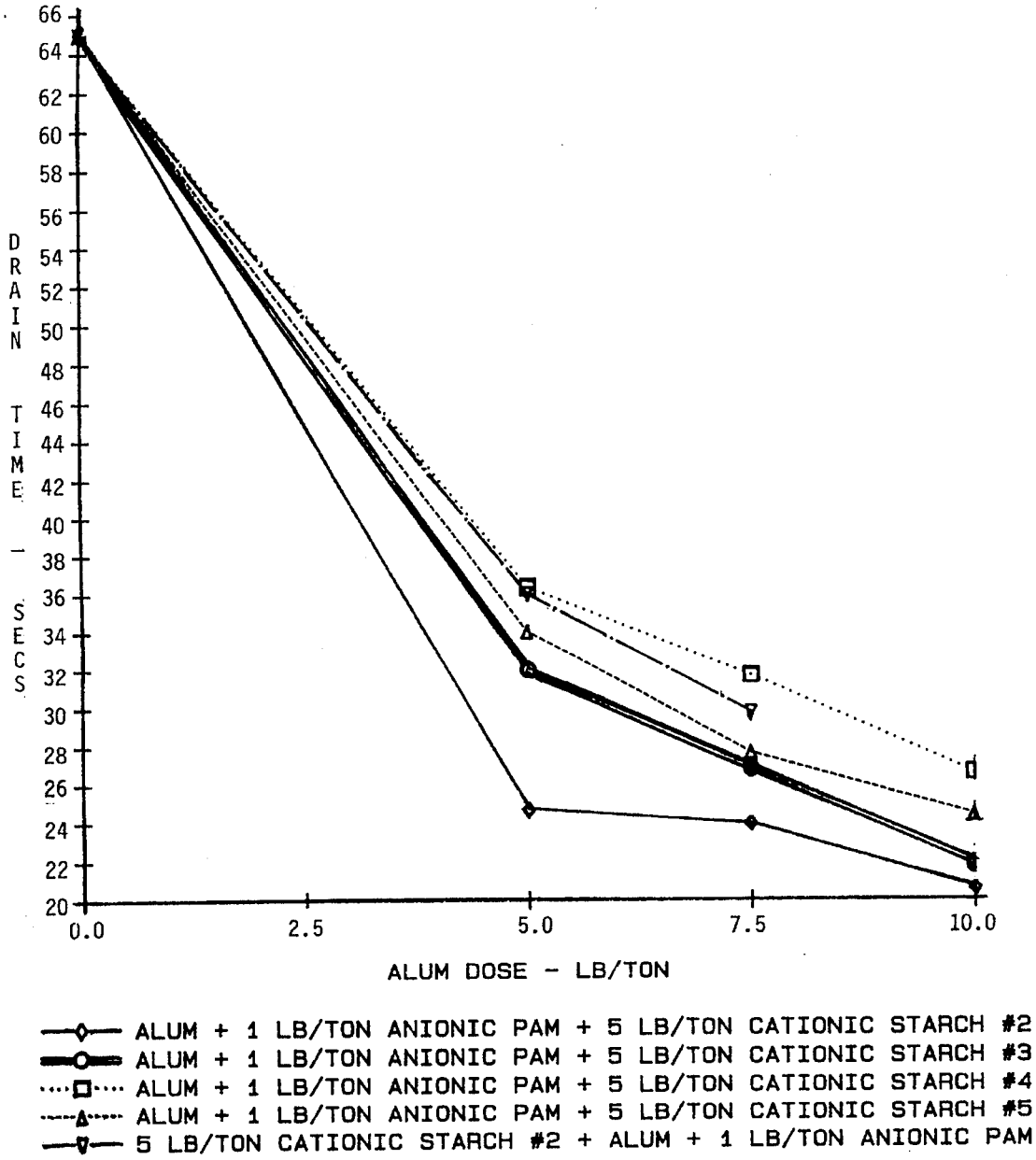
FIG. 2 shows the effect on drainage using the addition of alum, anionic PAM and different cationic starches.

Graphed data is illustrated in FIG. 2.

This data illustrates the claim of improved drainage with this invention.

Cationic starch #2 is a amylopectin based corn starch (waxy maize) similar in structure to cationic starch #1.

Cationic starch #3 is a corn starch mixture of amylose and amylopectin.

Cationic starch #4 is a corn starch of primarily amylose.

Cationic starch #5 is a potato starch of primarily amylose.

Anionic PAM #2 is a powder with a 30% charge moiety and an IV of 17.0.

Example 3

Bleached, kraft, hardwood/softwood alkaline pulp from an eastern United States mill, refined to a 400 to 450 CSF, was evaluated for drainage improvements on the British Standard device at an equivalent 100 pound per 3300 square feet. Results are shown in Table III.

TABLE III

| COMPONENT SYSTEM | COMPONENT DOSE, LB/TON | DRAIN TIME, SECONDS |
|---|---|---|
| ALUM/ANIONIC PAM #3 | 5/3 | 38.7 |
| (EMULSION) | 7.5/3 | 27.2 |
| | 10/3 | 23.0 |
| ALUM/ANIONIC PAM #3/ | 5/3/5 | 26.1 |
| CATIONIC STARCH #1 | 7.5/3/5 | 23.1 |
| | 10/3/5 | 22.5 |

Figure 3:
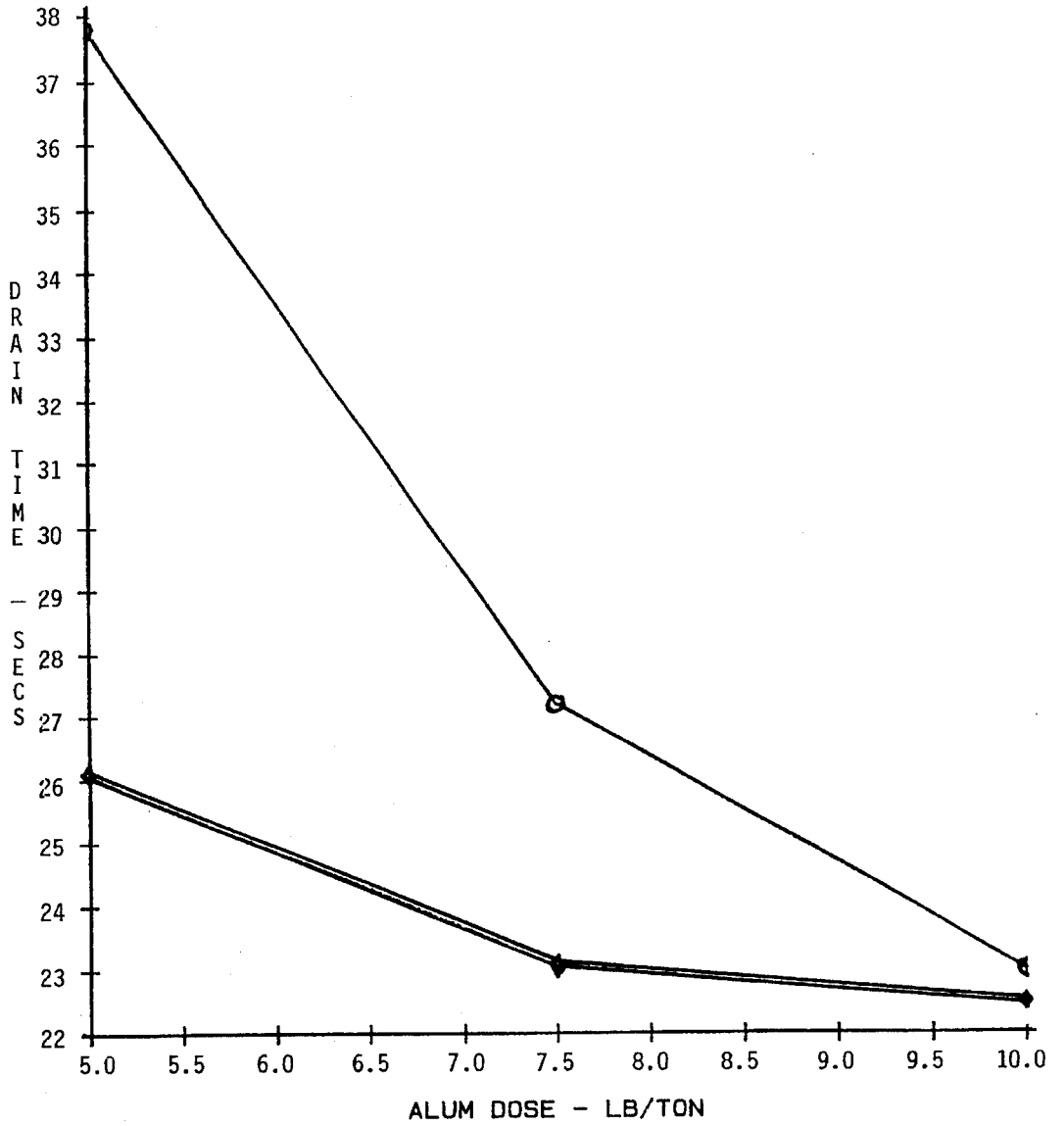
FIGS. 3 and 4 are comparisons of the drainage effect between the addition of alum and anionic PAM and the addition of alum, anionic PAM and cationic starch.

This data is illustrated in FIG. 3.

Anionic PAM #3 contains a % charge moiety of 30% and an IV of 18.0 dl/gram.

Example 4

Bleached, kraft, hardwood/softwood alkaline furnish from a north-east mill, refined to a 300 to 350 CSF, was evaluated for drainage response on the Canadian Standard Freeness device (the design of this device indicates a faster drainage response at a higher mls value ). Results are shown in Table IV

TABLE IV

| COMPONENT SYSTEM | COMPONENT DOSE, LB/TON | DRAIN RATE, mis |
|---|---|---|
| BLANK | — | 355 |
| ALUM/ANIONIC PAM #3 | 5 /1.5 | 487 |
| | 5/2.25 | 517 |
| | 5/3.0 | 542 |
| | 5/3.75 | 547 |
| ALUM/ANIONIC PAM #3/ | 5/1.5/5 | 527 |
| CATIONIC STARCH #1 | 5/2.25/5 | 567 |
| | 5/3.0/ 5 | 571 |

Figure 4:
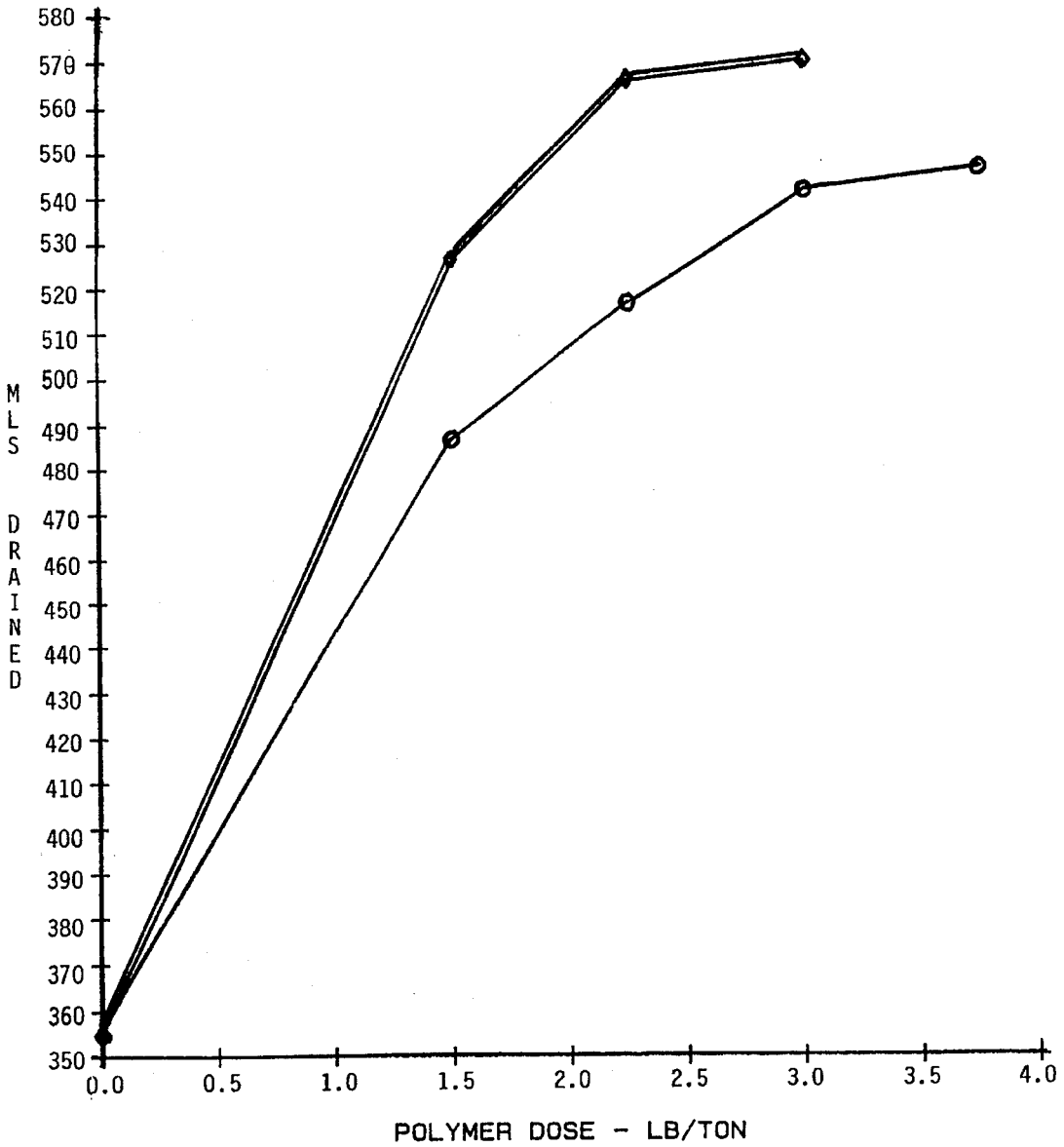

This data is illustrated in FIG. 4.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What we claim is:

1. A method for draining water from an alkaline pulp slurry during the formation of paper in a papermaking operation comprising adding to the pulp slurry an amount sufficient to expedite the drainage of water from the pulp slurry of, in sequential order, from about 1.0 to 15 pounds per ton of alum, from about 0.1 to 5.0 pounds per ton of an ionic poly-acrylamide drainage and retention aid and from about 2.5 to 30 pounds per ton of cationic starch.

2. The method of claim 1 wherein the alum is added at the fan pump, the ionic polyacrylamide is added after the fan pump and the cationic starch is added before or after the primary screen.

3. The method of claim 1 wherein the ionic polyacrylamide is anionic.

4. The method of claim 3 wherein the anionic polyacrylamide is in the form of a powder.

5. The method of claim 3 wherein the anionic polyacrylamide is in the form of an emulsion.

6. The method of claim 5 wherein the anionic polyacrylamide emulsion is added at a concentration of 0.2 to 20 pounds per ton of pulp slurry.

7. The method of claim 1 wherein the cationic starch is derived from a compound selected from the group consisting of corn, potatoes, wheat, rice and tapioca.

8. The method of claim 7 wherein the cationic starch is derived from corn.

9. The method of claim 7 wherein the cationic starch is cationized with amine groups.

10. The method of claim 9 wherein the amount of amine groups is represented by the degree of substitution.

11. The method of claim 10 wherein the degree of substitution is from about 0.01 to 0.10.

12. The method of claim 11 wherein the degree of substitution is from about 0.02 to 0.04.

13. The method of claim 1 wherein the amount of cationic starch added to the pulp slurry is, based on actives, about 2.5 to 15 pounds per ton of pulp slurry.

14. The method of claim 1 wherein the alum is selected from the group consisting of aluminum sulfate and polyaluminum chloride.

* * * * *